US008622219B2

(12) United States Patent
Malmberg

(10) Patent No.: US 8,622,219 B2
(45) Date of Patent: Jan. 7, 2014

(54) SCREENING MAT FOR VIBRATING SCREEN DEVICES

(75) Inventor: Mats Malmberg, Rydsgård (SE)

(73) Assignee: Sandvik Intellectual Property AB, Sandviken (SE)

( * ) Notice: Subject to any disclaimer, the term of this patent is extended or adjusted under 35 U.S.C. 154(b) by 224 days.

(21) Appl. No.: 13/034,235

(22) Filed: Feb. 24, 2011

(65) Prior Publication Data

US 2011/0215033 A1 Sep. 8, 2011

(30) Foreign Application Priority Data

Mar. 3, 2010 (SE) ..... 1050199

(51) Int. Cl.
*B07B 1/46* (2006.01)

(52) U.S. Cl.
USPC ..... 209/397

(58) Field of Classification Search
USPC ..... 209/392, 397, 931
See application file for complete search history.

(56) References Cited

U.S. PATENT DOCUMENTS

| | | | | |
|---|---|---|---|---|
| 3,848,744 | A * | 11/1974 | Flaherty | 209/393 |
| 4,885,040 | A | 12/1989 | Wolff | |
| 5,183,598 | A * | 2/1993 | Helle et al. | 264/401 |
| 5,258,445 | A * | 11/1993 | Sperk et al. | 524/507 |
| 6,253,926 | B1 * | 7/2001 | Woodgate | 209/399 |
| 6,756,412 | B2 * | 6/2004 | Muzzy | 521/48 |
| 7,296,685 | B2 | 11/2007 | Malmberg | |
| 7,654,394 | B2 * | 2/2010 | LaVeine et al. | 209/310 |
| 8,047,380 | B2 * | 11/2011 | Van Rensburg | 209/397 |
| 8,371,450 | B2 * | 2/2013 | McGregor et al. | 209/405 |
| 2005/0189265 | A1 | 9/2005 | Malmberg | |
| 2007/0000817 | A1 | 1/2007 | Malmberg | |
| 2007/0138066 | A1 | 6/2007 | Malmberg | |
| 2007/0144945 | A1 | 6/2007 | Malmberg | |
| 2008/0257791 | A1 | 10/2008 | Malmberg | |
| 2009/0166268 | A1 | 7/2009 | Malmberg | |
| 2009/0285049 | A1 | 11/2009 | Malmberg | |
| 2011/0189467 | A1 * | 8/2011 | Costa | 428/311.11 |
| 2011/0215032 | A1 | 9/2011 | Malmberg | |
| 2011/0215033 | A1 | 9/2011 | Malmberg | |
| 2011/0220556 | A1 | 9/2011 | Malmberg | |
| 2012/0199551 | A1 * | 8/2012 | Kwok | 216/41 |

FOREIGN PATENT DOCUMENTS

| | | | |
|---|---|---|---|
| SE | 430473 | B | 11/1983 |
| WO | WO-2008014552 | A1 | 2/2008 |

OTHER PUBLICATIONS

International Search Report from corresponding International application No. PCT/SE2011/050073, dated Jun. 7, 2011, 4 pages.

* cited by examiner

*Primary Examiner* — Joseph C Rodriguez
(74) *Attorney, Agent, or Firm* — Morgan, Lewis & Bockius LLP

(57) ABSTRACT

A screening media for use in vibrating screen devices that fractionize crushed stones or gravel. The screening media is made by extruding a fiber-reinforced rubber or polymeric material to form a strip in a length longer than that needed to make individual screening mats for use in the vibrating screen devices. Screening apertures are then punched in the strip, and the apertured strip is cut into individual mats. The extruded strip includes side portions configured to connect to support structures of the vibrating device. Prior to the cutting step, the apertured strip can be maintained in the form of a coil or a long-length element.

14 Claims, 3 Drawing Sheets

SCREENING MAT FOR VIBRATING SCREEN DEVICES

RELATED APPLICATION DATA

This application claims priority under 35 U.S.C. §119 and/or §365 to Swedish patent application No. 1050199-7, filed Mar. 3, 2010, the entire contents of which are incorporated herein by reference.

FIELD

The present disclosure concerns screening media to be used in a vibrating screen device that fractionizes crushed stones or gravel.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Vibrating screen devices are used to fractionize for example crushed stones and gravel into fractions of stones with different sizes. For the fractionizing, screening media is used having screening holes, whereby stones smaller than the screening apertures will pass through the screening apertures. Stones bigger than the screening apertures will be transported on top of the screening media and feed out at the end of the vibrating screen device.

The screening media has traditionally been made in a press or formed in a mold.

SUMMARY

Disclosed herein is screening media for use in a vibrating screen device for fractionizing crushed stones or gravel, wherein the screening media comprises an extruded element.

The screening media is made by extruding a strip which is longer than that needed for individual mats, forming apertures in the strip, preferably by punching, and then cutting the apertured strip into screening mats of appropriate widths or lengths.

The screening media is preferably made of a rubber or polymeric material. In extrusion, the screening strips are produced either longitudinally or transversally. The extruded screening media has side parts adapted to be fixed in a carrier or support of the vibrating screen.

By making the screening media through extrusion, the manufacturing process may be faster, endless screening mats may be produced, the manufacturing costs are lowered, and the manufacturing is more flexible.

To reinforce the screening media, fibers are integrated in the rubber or polymeric material used for the extrusion. By incorporating the integrated fibers, the strength of the screening media will increase. The fibers may be made of a polymer, such as polyester or polyamide, or any other suitable material giving a reinforcement of the screening media. In one embodiment, carbon fibers are used. The screening media is normally made of rubber or polyurethane. The material of the screening media is reusable.

By means of the reinforcement, the screening media will be able to take a bigger load without yielding. Thereby, it is possible to decrease the thickness of the screening media. It is also possible to decrease the amount of material between the openings of the screening media, thus increasing the total open area of the screening media. These measures will increase the screening efficiency of the screening media.

By means of the reinforcing fibers, the stability of the screening media is increased. The increased dimensional stability makes it possible to have a closer fit in the aperture-punching step.

The extrusion of the rubber or polymeric material, including reinforcing fibers, gives the same properties throughout the entire screening media. By controlling the ratio of the reinforcing fibers in the screening media, it is possible to control the properties of the extruded screening media without amending the rubber material. Thus, the same rubber or polymeric material may be used independently of the desired characteristics of the screening media.

For maintaining the extruded screening media during storage and transportation, the extruded screening media may be rolled into coils. In time of use, screening media is rolled off from the coil and cut into suitable lengths.

Alternatively, the extruded screening media could be maintained in relatively long lengths and then cut into appropriate lengths when needed.

The screening mats, whether cut from coils or long lengths, are then installed in the vibrating screen device. Conventionally, the screening mats have been stored and transported in the form of modules which include a support structure for the screening mat. However, the only part that is worn during normal use is the screening mat. By only replacing the screening mats, rather than using the conventional modules that include a support structure, fewer parts need to be transported and discarded, which is beneficial both financially and environmentally. Furthermore, the parts replaced are of the one and same material, making recycling easier.

Further objects and advantages of the present invention will be obvious to a person skilled in the art when reading the detailed description below of different embodiments of the invention.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

A person skilled in the art will realize that the cross sectional form of the screening media may vary within the scope of protection of the present invention.

Figure 1:
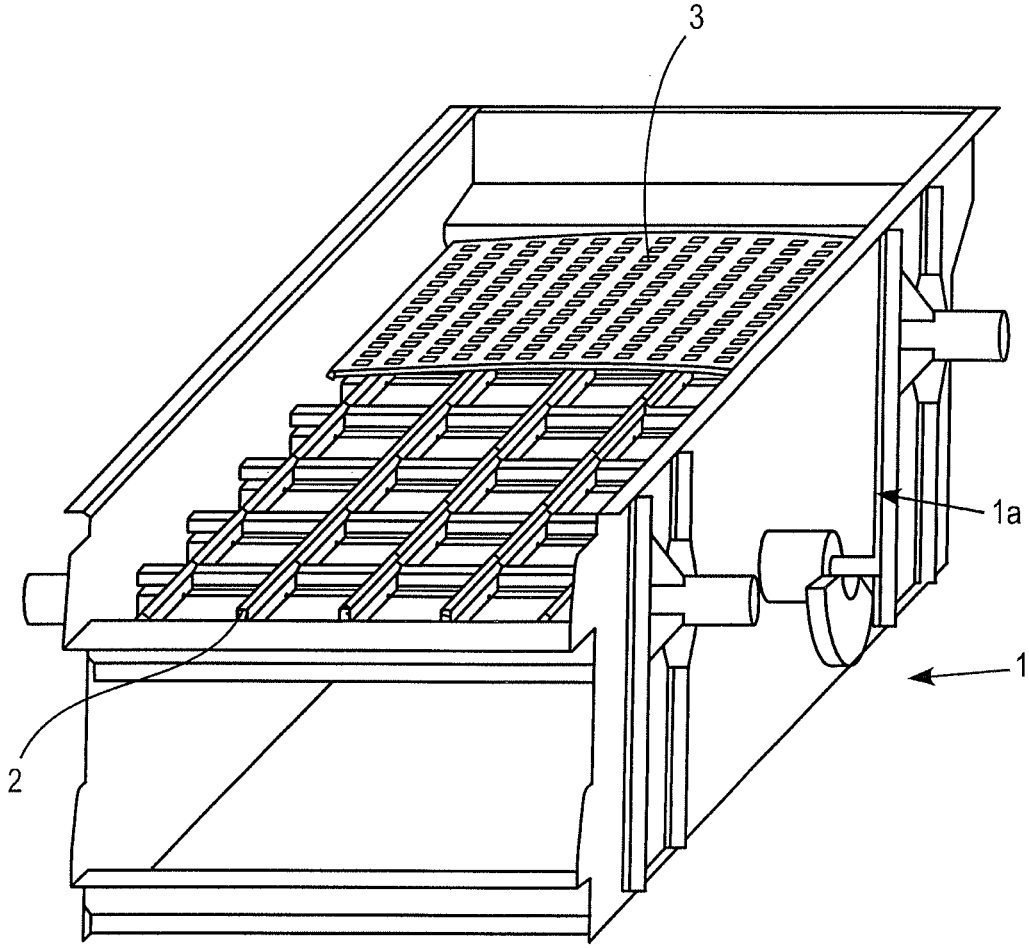
FIG. 1 is a perspective view of a vibrating screen device in which screening media according to the present invention may be used.

In FIG. 1 one example of a vibrating screen device 1 is shown schematically. Normally, the vibrating screen device 1 has a frame 1*a* to which is mounted a support structure 2 on which screening mats 3 are placed. Normally, a number of screening mats 3 are placed side by side.

Figure 2A:
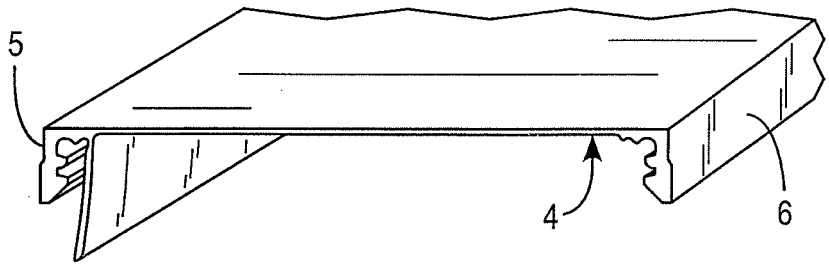
FIG. 2*a* is a fragmentary perspective view of one example of a screening media strip after being extruded but not yet formed with screening apertures.
Figure 2B:
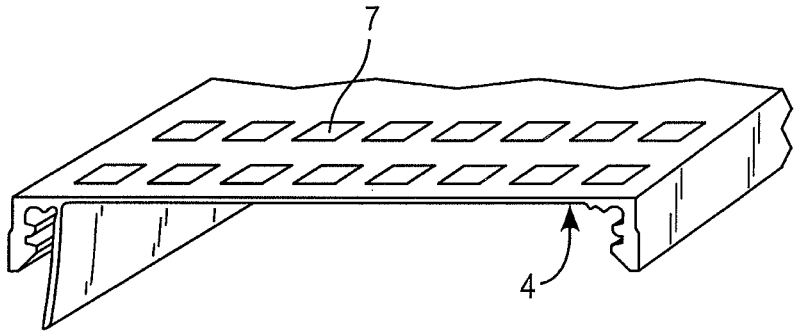
FIG. 2*b* is a view similar to FIG. 2*a* after apertures have been formed in the strip.

The screening media is formed by extruding a strip 4 (see FIG. 2*a*) in a length greater than that of the mats that are to be formed from the screen. Then, the strip is formed with apertures 7 (see FIG. 2*b*) to form an elongated screening media strip which is to be cut into individual mats 3 of required length. In FIGS. 2*c*-2*i* one general example of a screening media strip 4 is shown with different dimensions, respectively.

The shown screening media strips 4 have side parts 5, 6, which are configured to be received in a carrier or the like of the support structure 2, to fix the screening mats 3 to the support structure 2. See for example the inventor's U.S. Pat. No. 7,296,685 the disclosure of which is incorporated herein by reference.

The exact form of the side parts 5, 6 of the screening media strip 4 is of no importance to the present invention and may vary depending on the design of the vibrating screen device 1 and the parts receiving the side parts 5, 6 of respective screening mat 3. The side parts 5, 6 are integrated parts of the screening media strip 4, and are thus formed in the extrusion step. By using extrusion as the manufacturing method, it is relatively easy to vary the forms and dimensions of the extruded screening media.

The screening media strip can be extruded in the longitudinal direction, or in the transverse direction. After the extrusion step, the screening apertures 7 are formed in the screening media strip 4, preferably by a punching step.

Figure 3:
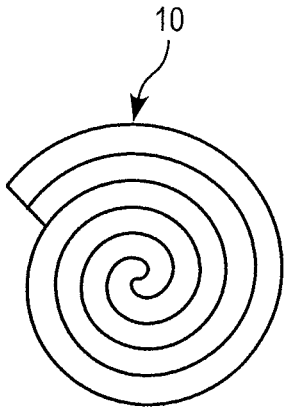
FIG. 3 is a schematic side view of a screening media strip which has been formed into a coil.
Figure 2C:
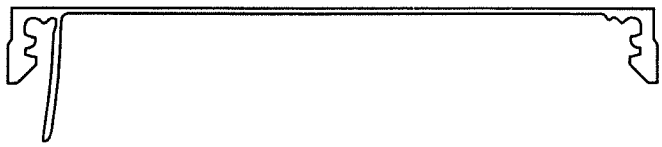
FIGS. 2*c*-2*i* are end elevational views of respective screening media strips of the same shape and different dimension after having screening apertures formed therein.
Figure 2D:
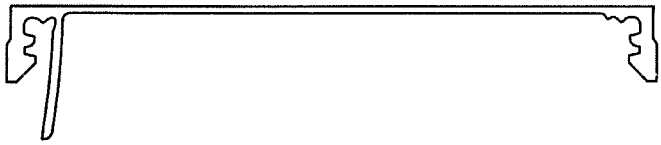
Figure 2E:
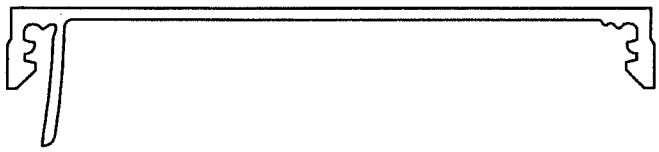
Figure 2F:
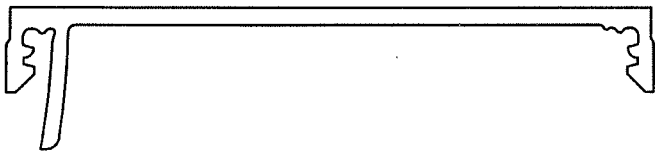
Figure 2G:
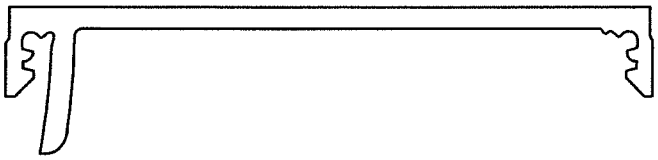
Figure 2H:
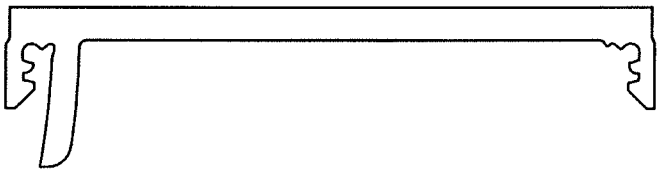
Figure 2I:
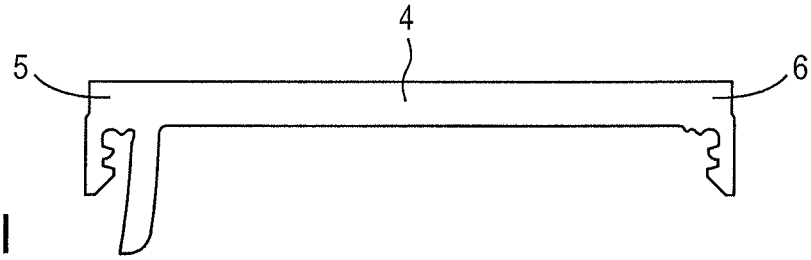

The extruded screen media strip 4 is then normally rolled into a coil 10 (see FIG. 3) of appropriate size, or immediately cut into relatively long lengths and maintained in that condition prior to the cutting step. If rolled into a coil, the screening media strip 4 is rolled off from the formed coil in time of use, and screening mats 3 are cut in lengths or widths appropriate for the particular vibrating screen device 1 in which the screening mats 3 are to be installed. If the screening media is instead delivered in long lengths, it is also cut to appropriate lengths at time of use.

The material from which the screening media strip 4 is extruded is preferably formed by blending or otherwise integrating fibers into a polymeric or rubber material. The fibers may be made of a polymer, such as polyester or polyamide, or they may be carbon fibers. By means of the fibers, the extruded screening media 4 is reinforced. Thereby, the screening media 4 may take a bigger load without yielding. It is possible to control the properties of the screening media 4 by controlling the amount of reinforcing fibers in the screening media.

Although preferred embodiments have been disclosed, it will be appreciated by those skilled in the art that additions, deletions, modifications and substitutions not specifically described may be made without departing from the spirit and scope of the invention as defined in the appended claims.

What is claimed is:

1. A method of manufacturing screening mats for use in a vibrating screen device that fractionizes crushed stones or gravel, comprising the steps of:

A. extruding an elongated screening media strip of a length greater than that of individual mats to be formed therefrom;

B. forming apertures in the screening media strip, the apertures extending from a first planar side of the strip to an opposing second planar side of the strip; and C. cutting the apertured screening media strip into individual mats subsequent to step B, wherein the step of extruding includes providing side parts at opposing distal edges of the extruded strip, the side parts being integrated parts of the strip formed in the extruding process and extending outwardly from the second planar side of the strip, and wherein the side parts comprise a first side part and a second side part, the first side part including a pair of projections separated in a direction of the plane of the extruded strip to define opposing interior wall surfaces of a channel, the channel extending along a first of the opposing distal edges of the extruded strip, and the second side part including a single projection.

2. The method as claimed in claim 1, wherein the extruded strip comprises a rubber or polymeric material in which fibers are integrated.

3. The method as claimed in claim 2, wherein the polymeric material is polyurethane.

4. The method as claimed in claim 2, wherein the fibers are formed from one of polyester, polyamide or carbon.

5. The method as claimed in claim 1, wherein the side parts are configured to connect to a support structure of the vibrating screen device.

6. The method as claimed in claim 1, wherein the apertured strip is maintained in the form of a coil subsequent to step B and prior to the cutting step.

7. The method as claimed in claim 1, wherein the side parts and the strip form a corner at the opposing distal edges.

8. The method as claimed in claim 1, wherein a first projection of the pair of projections has a length from the second planar side of the strip that is shorter than a length from the second planar side of the strip of a second projection of the pair of projections.

9. The method as claimed in claim 8, wherein the first projection includes a first plurality of protrusions on the interior wall surface.

10. The method as claimed in claim 1, wherein a first projection of the first side part includes a first plurality of protrusions on the interior wall surface.

11. The method as claimed in claim 10, wherein the first plurality of protrusions form ribs that extend on the interior wall surface a length of the first of the opposing distal edges of the extruded strip.

12. The method as claimed in claim 10, wherein the projection of the second side part includes a second plurality of protrusions on a surface of the projection that is oriented toward the opposing distal edge.

13. The method as claimed in claim 12, wherein the second plurality of protrusions form ribs that extend on the surface of the projection a length of a second of the opposing distal edges of the extruded strip.

14. The method as claimed in claim 1, wherein the elongated media strip and side parts are formed of the same extruded material.

* * * * *